US007289031B1

(12) United States Patent
Hock

(10) Patent No.: US 7,289,031 B1
(45) Date of Patent: Oct. 30, 2007

(54) MONITORED FELON WARNING SYSTEM

(75) Inventor: Daniel B. Hock, Seminole, FL (US)

(73) Assignee: Carol G. Hock, Centerville, OH (US)

( * ) Notice: Subject to any disclaimer, the term of this patent is extended or adjusted under 35 U.S.C. 154(b) by 204 days.

(21) Appl. No.: 11/290,004

(22) Filed: Nov. 30, 2005

(51) Int. Cl.
*G08B 23/00* (2006.01)

(52) U.S. Cl. ..... 340/573.4; 340/573.1; 340/572.1; 340/539.13; 455/456.1

(58) Field of Classification Search ..... 340/573.4
See application file for complete search history.

(56) References Cited

U.S. PATENT DOCUMENTS 5,396,227 A * 3/1995 Carroll et al. ..... 340/825.36
5,982,281 A * 11/1999 Layson, Jr. ..... 340/573.4
6,014,080 A * 1/2000 Layson, Jr. ..... 340/573.4
6,054,928 A * 4/2000 Lemelson et al. ..... 340/573.4
6,072,396 A * 6/2000 Gaukel ..... 340/573.4
6,100,806 A * 8/2000 Gaukel ..... 340/573.4
6,362,778 B2 * 3/2002 Neher ..... 342/357.07
6,639,516 B1 * 10/2003 Copley ..... 340/573.4
6,674,368 B2 * 1/2004 Hawkins et al. ..... 340/573.4
6,828,908 B2 * 12/2004 Clark ..... 340/573.1
6,889,135 B2 * 5/2005 Curatolo et al. ..... 340/572.1
6,972,684 B2 * 12/2005 Copley ..... 340/573.4
7,015,817 B2 * 3/2006 Copley et al. ..... 340/573.4
7,098,795 B2 * 8/2006 Adamczyk et al. ..... 340/573.4
7,102,508 B2 * 9/2006 Edelstein et al. ..... 340/539.13
7,123,141 B2 * 10/2006 Contestabile ..... 340/573.4
2002/0063626 A1 * 5/2002 Pitzer et al. ..... 340/573.1
2005/0099309 A1 * 5/2005 Hum et al. ..... 340/573.4
2005/0285747 A1 * 12/2005 Kozlay ..... 340/573.4
2006/0063540 A1 * 3/2006 Beuck ..... 340/539.13
2007/0069890 A1 * 3/2007 Tuck ..... 340/539.13

* cited by examiner

*Primary Examiner*—Benjamin C. Lee
*Assistant Examiner*—Eric M. Blount
(74) *Attorney, Agent, or Firm*—Edward P. Dutkiewicz

(57) ABSTRACT

A monitored felon warning system has a police computer having a felon data base. The system also has a global positioning system, also known as GPS, and a sending subassembly having a circuit, with the transmitter being capable of transmitting a first signal to a receiver. The receiver gives off an alarm and also causes a display of warning material, such as a photograph to be displayed on the cell phone screen.

7 Claims, 5 Drawing Sheets

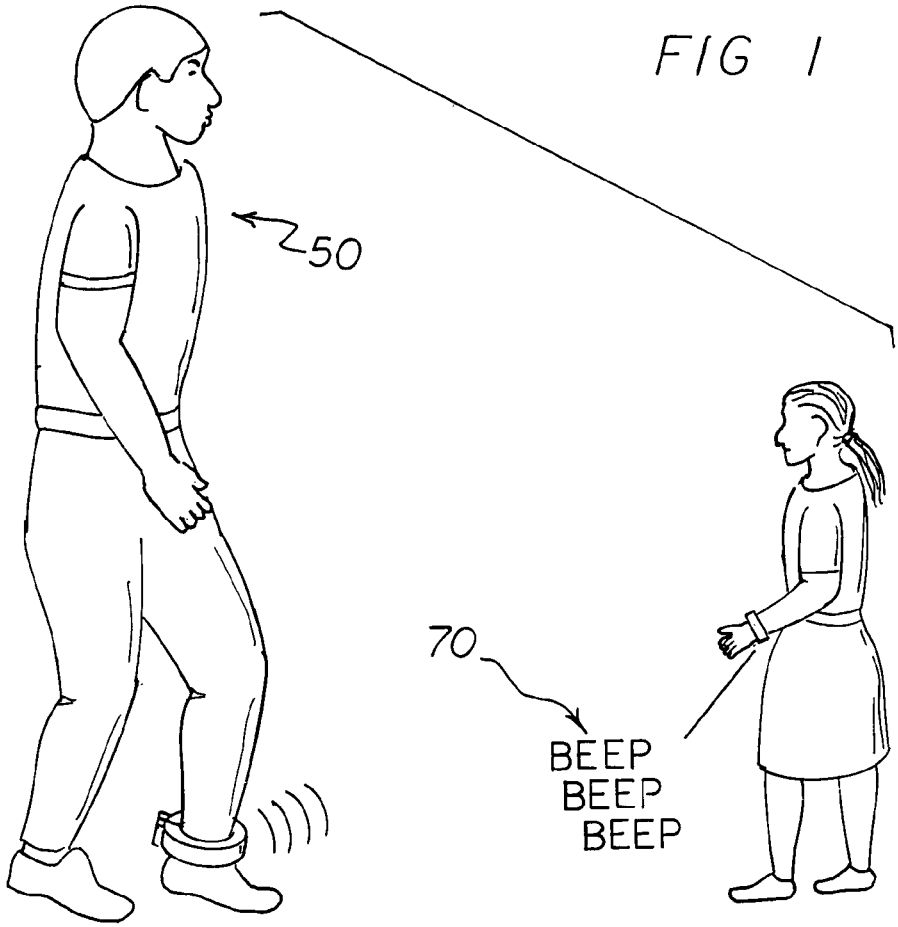
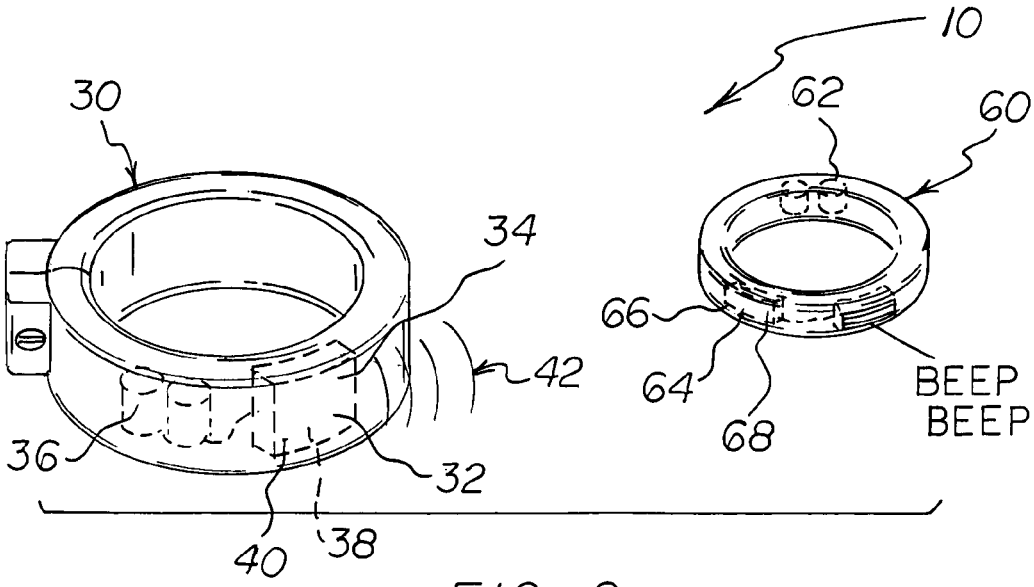
FIG 2

FIG 3
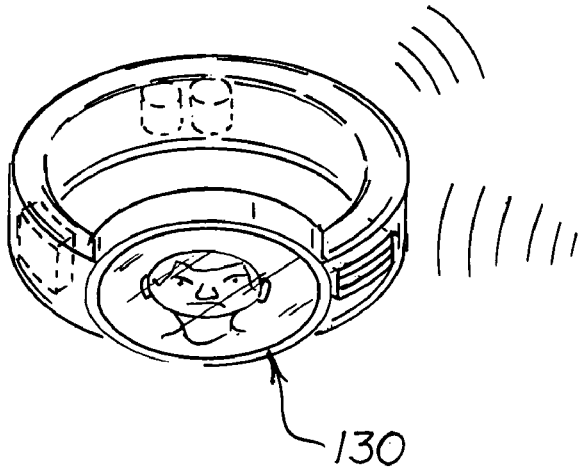
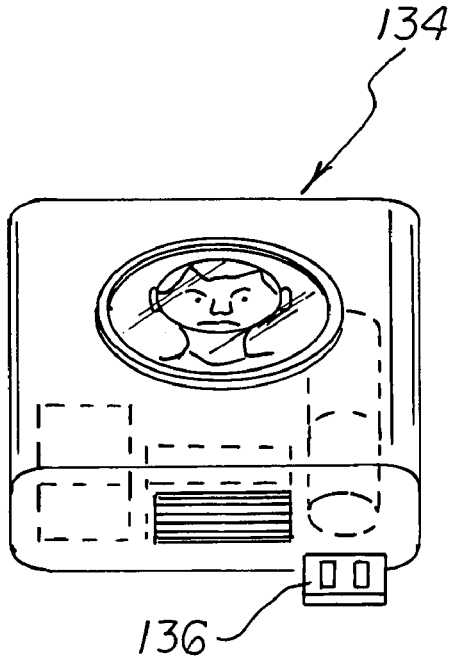
FIG 4

FIG 5
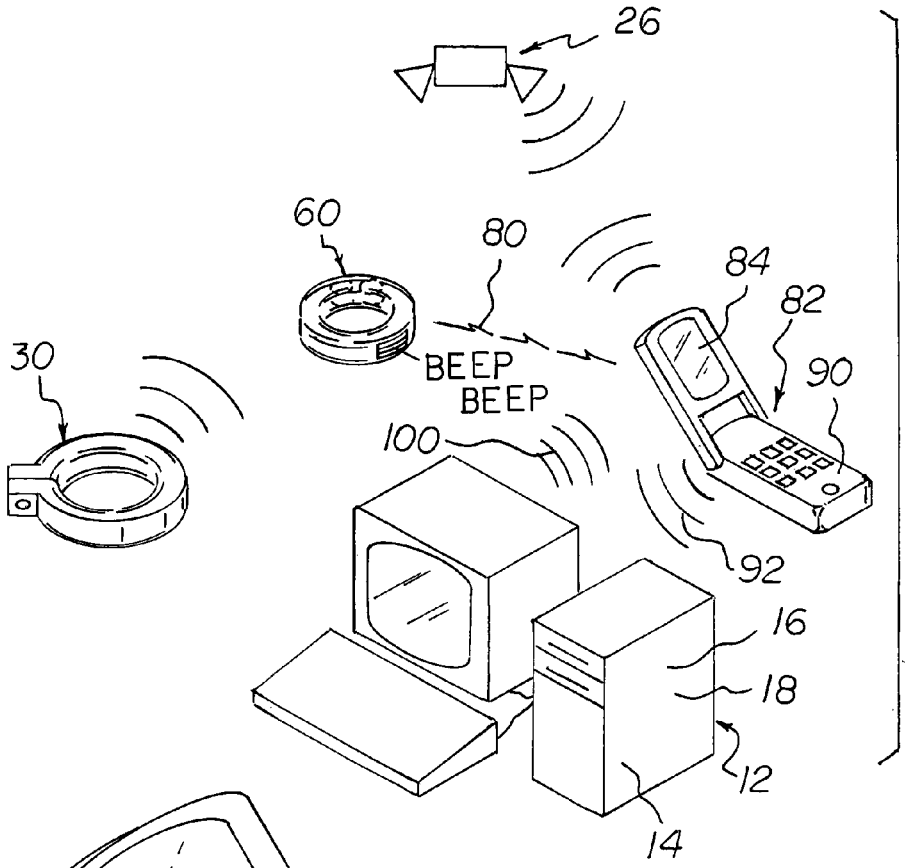
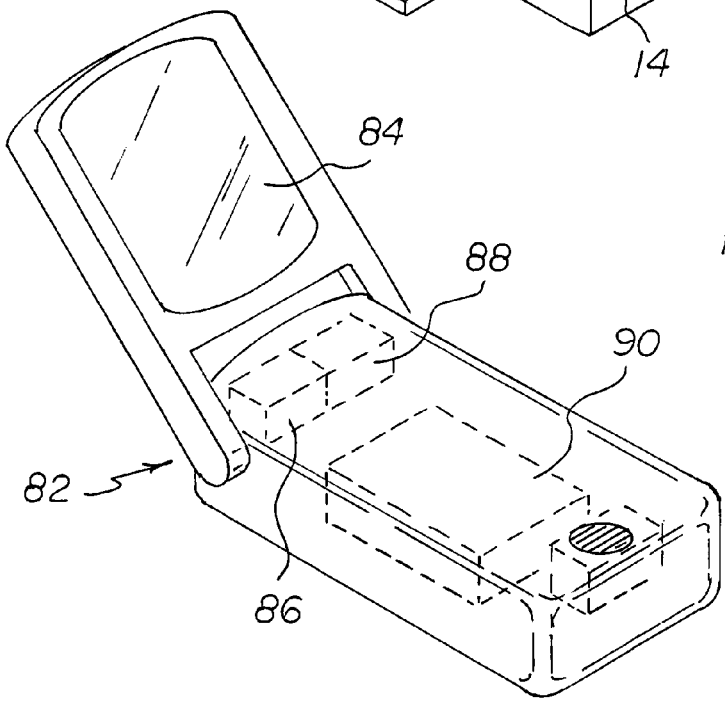
FIG 6

MONITORED FELON WARNING SYSTEM

BACKGROUND OF THE INVENTION

1. Field of the Invention

The present invention relates to a monitored felon warning system and more particularly pertains to monitoring felons and persons under court order.

2. Description of the Prior Art

The use of monitoring devices of known configurations is known in the prior art. More specifically, monitoring devices of known configurations previously devised and utilized for the purpose of monitoring the location of persons are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,782,778 issued on Jul. 21, 1998 to De Briere et al discloses an apparatus and method for detecting and monitoring the sexual arousal of an individual. U.S. Pat. No. 6,359,579 issued to Adcox et al on Mar. 19, 2002 discloses a vehicle-status device and system for remotely updating and locally indicating the status of a vehicle. U.S. Pat. No. 6,567,504 issued to Kercheval et al on May 20, 2003 discloses an automated calling system with database updating. Lastly, U.S. Pat. No. 6,606,304 issued to Grinter et al on Aug. 12, 2003 discloses a system for real-time monitor and response.

While these devices fulfill their respective, particular objectives and requirements, the aforementioned patents do not describe a monitored felon warning system that allows monitoring felons and persons under court order.

In this respect, the monitored felon warning system according to the present invention substantially departs from the conventional concepts and designs of the prior art, and in doing so provides an apparatus primarily developed for the purpose of monitoring felons and persons under court order.

Therefore, it can be appreciated that there exists a continuing need for a new and improved monitored felon warning system which can be used for monitoring felons and persons under court order. In this regard, the present invention substantially fulfills this need.

SUMMARY OF THE INVENTION

In view of the foregoing disadvantages inherent in the known types of monitoring devices of known configurations now present in the prior art, the present invention provides an improved monitored felon warning system. As such, the general purpose of the present invention, which will be described subsequently in greater detail, is to provide a new and improved monitored felon warning system and method which has all the advantages of the prior art and none of the disadvantages.

To attain this, the present invention essentially comprises a monitored felon warning system for allowing a user to get information of approaching monitored felons. The system comprises several components, in combination.

First provided is a police computer. The police computer has a felon data base. The computer has a memory and a processor. The computer is electronically coupled to a cellular telephone system. The data base of the computer is configured to store information concerning a member of the class of persons that includes convicted felons and persons under court order. Each member of the class of persons is identified with a unique identifying code. The data base also is enabled to transmit warning information concerning convicted felons and persons under court order via the cellular telephone system. The warning information transmitted is a member of the class of information that includes physical description, photograph and warnings, including "be-on-the-look-out", or BOLO warnings.

Next provided is a global positioning system, also known as GPS.

Next provided is a sending subassembly. The sending subassembly has a circuit. The circuit comprises a processor, a power source, a transmitter and a global positioning system location identifier. The transmitter is capable of transmitting a first signal. The first signal contains the unique identifying code and the GPS location of the sending subassembly.

Next provided is a person wearing the sending subassembly. The person is a member of class of persons that includes convicted felons and persons under court order. A person under court order may include persons who are the subject of restraining orders to keep a certain distance from an other person or a place.

Next provided is a receiving subassembly. The receiving subassembly comprises a power source and a circuit. The circuit comprises a memory, a processor, a receiver, a transmitter, a global positioning system location identifier and an alarm. The alarm is a member of the class of alarms that includes audio alarm, tactile alarm and visual alarm. The receiver subassembly is capable of receiving and processing the first signal containing the unique identifying code and the GPS location originating from the sending subassembly. The receiver subassembly is configured to produce a second signal. The second signal comprises the unique identifier, the receiver subassembly GPS location and the sending subassembly GPS location.

Next provided is a cell phone having an LCD screen. The cell phone has a circuit, an associated processor and an associated memory. The cell phone is electronically coupled to the receiving subassembly. The cell phone is also electronically coupled to the felon data base. The cell phone receives the second signal from the receiving subassembly. The cell phone then couples to the data base and transmits the contents of the second signal to the data base, where it is processed and stored.

Lastly provided is the data base, upon receiving the contents of the second signal, then generates and transmits a third signal containing the felon's warning information to the cell phone. The warning information is then displayed on the LCD of the cell phone for the user to view.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved monitored felon warning system which has all of the advantages of the prior art monitoring devices of known configurations and none of the disadvantages.

It is another object of the present invention to provide a new and improved monitored felon warning system which may be easily and efficiently manufactured and marketed.

It is further object of the present invention to provide a new and improved monitored felon warning system which is of durable and reliable constructions.

An even further object of the present invention is to provide a new and improved monitored felon warning system which is susceptible of a low cost of manufacture with regard to both materials and labor, and which accordingly is then susceptible of low prices of sale to the consuming public, thereby making such a monitored felon warning system economically available to the buying public.

Even still another object of the present invention is to provide a monitored felon warning system for monitoring felons and persons under court order.

Lastly, it is an object of the present invention to provide a new and improved monitored felon warning system comprising a police computer having a felon data base. The system also comprises a global positioning system, also known as GPS, and a sending subassembly having a circuit, with the transmitter be capable of transmitting a first signal to a receiver. The receiver gives off an alarm and also causes a display of warning material, such as a photograph to be displayed on the cell phone screen.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an overview of the system and the relation of the sender and receiver.

FIG. 2 is a perspective view of the sender and the receiver.

FIG. 3 is a perspective view of the receiver showing the receiver having a display screen.

FIG. 4 is a perspective view of the configuration of the present invention where the receiver is in a pocket carried configuration.

FIG. 5 is a perspective overview of the system showing the relation of the parts that comprise the system.

FIG. 6 is a perspective of the cell phone use within the system.

The same reference numerals refer to the same parts throughout the various Figures.

DESCRIPTION OF THE PREFERRED EMBODIMENT

Figure 7:
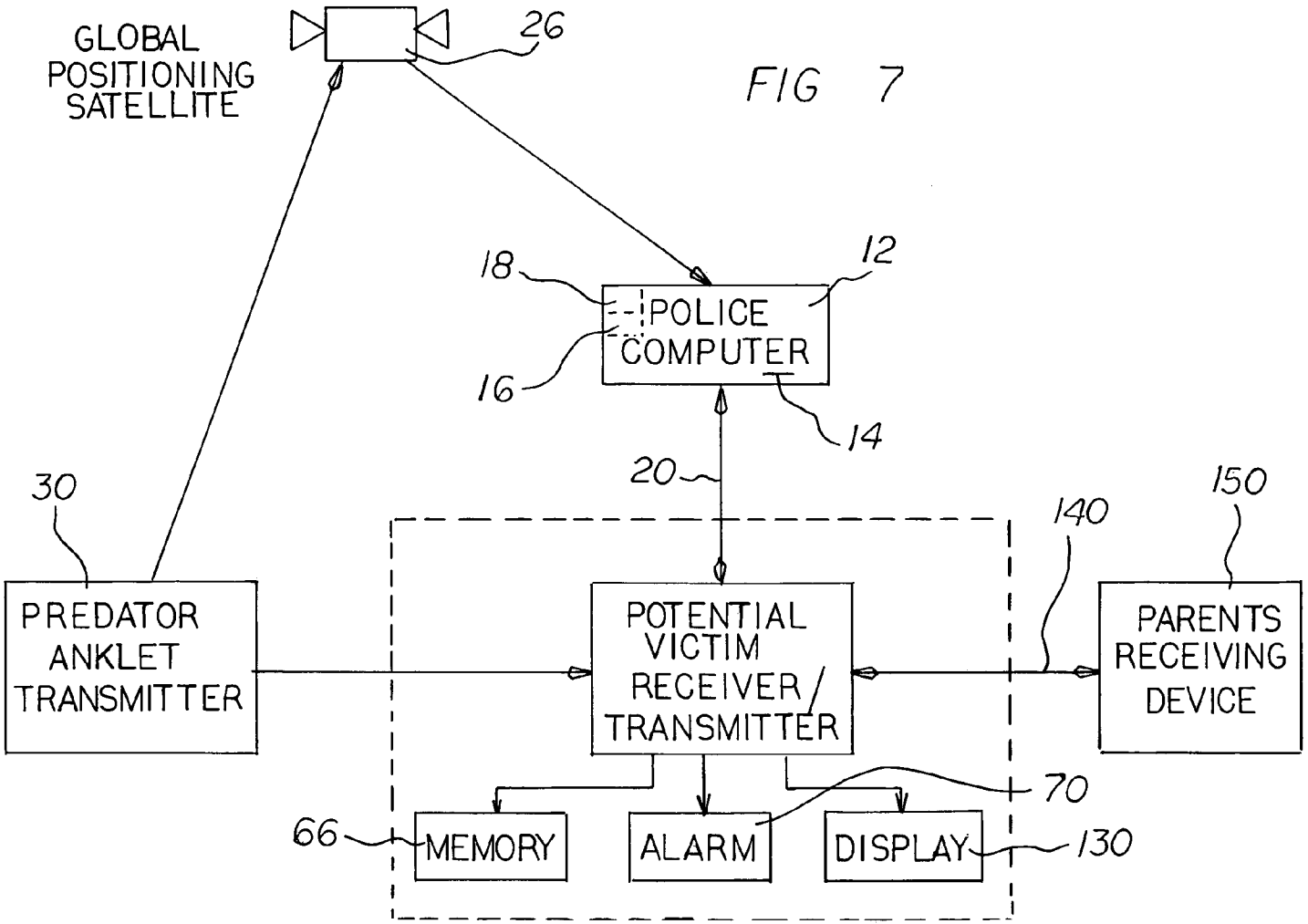
FIG. 7 is a schematic view of the system demonstrating the interaction between the components.
Figure 8:
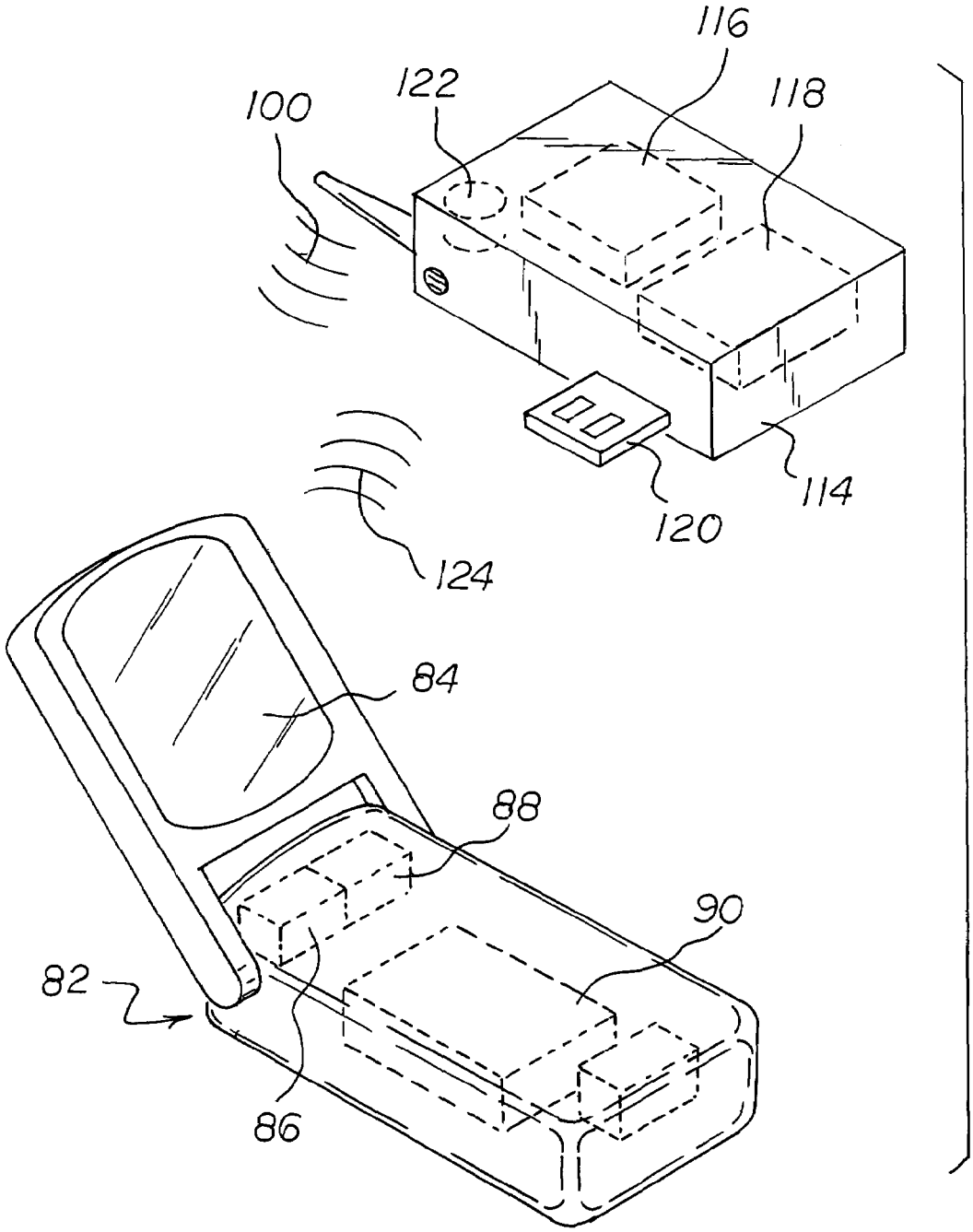
FIG. 8 is a view of a cell phone and a remote data base as anticipated by this invention.

With reference now to the drawings, and in particular to FIG. 1 thereof, the preferred embodiment of the new and improved A monitored felon warning system embodying the principles and concepts of the present invention and generally designated by the reference numeral 10 will be described.

The present invention, the monitored felon warning system 10 is comprised of a plurality of components. Such components in their broadest context include a sender, a receiver, a cell phone and a data base. Such components are individually configured and correlated with respect to each other so as to attain the desired objective.

A monitored felon warning system 10 for allowing a user to get information of approaching monitored felons. The system comprises several components, in combination.

First provided is a police computer 12. The police computer has a felon data base 14. The computer has a memory 16 and a processor 18. The computer is electronically coupled to a cellular telephone system 20. The data base of the computer is configured to store information concerning a member of the class of persons that includes convicted felons and persons under court order. Each member of the class of persons is identified with a unique identifying code. The data base also is enabled to transmit warning information concerning convicted felons and persons under court order via the cellular telephone system. The warning information transmitted is a member of the class of information that includes physical description, photograph and warnings, including "be-on-the-look-out", or BOLO warnings.

Next provided is a global positioning system 26, also known as GPS.

Next provided is a sending subassembly 30. The sending subassembly has a circuit 32. The circuit comprises a processor 34, a power source 36, a transmitter 38 and a global positioning system location identifier 40. The transmitter is capable of transmitting a first signal 42. The first signal contains the unique identifying code and the GPS location of the sending subassembly.

Next provided is a person wearing the sending subassembly 50. The person is a member of class of persons that includes convicted felons and persons under court order. A person under court order may include persons who are the subject of restraining orders to keep a certain distance from an other person or a place.

Next provided is a receiving subassembly 60. The receiving subassembly comprises a power source 62 and a circuit 64. The circuit comprises a memory 66, a processor 68, a receiver, a transmitter, a global positioning system location identifier and an alarm 70. The alarm is a member of the class of alarms that includes audio alarm, tactile alarm and visual alarm. The receiver subassembly is capable of receiving and processing the first signal containing the unique identifying code and the GPS location originating from the sending subassembly. The receiver subassembly is configured to produce a second signal 80. The second signal comprises the unique identifier, the receiver subassembly GPS location and the sending subassembly GPS location.

Next provided is a cell phone 82 having an LCD screen 84. The cell phone has a circuit 86, with an associated processor 88 and an associated memory 90. The cell phone is electronically coupled to the receiving subassembly and is configured to receive the second signal. The cell phone is also electronically coupled to the felon data base 92. The cell phone receives the second signal from the receiving subassembly. The cell phone then couples to the data base and transmits the contents of the second signal to the data base, where it is processed and stored.

Lastly, in the preferred embodiment, the data base, upon receiving the contents of the second signal, then generates and transmits a third signal 100 containing the felon's warning information to the cell phone. The warning information is then displayed on the LCD of the cell phone for the user to view.

In an alternate embodiment, there may be an associated memory storage device 114 into which the user is able to download the data base via a computer that is electronically linked to the police computer. The memory storage device has a memory 116, a processor 118, an input link 120 and a power source 122. The memory storage device is kept in proximity to the cell phone, and is in electronic communication with the cell phone. The memory storage device acts as a remote memory and processor for the cell phone. In this embodiment the receiver detects the first signal and then sends the second signal to the cell phone. The cell phone electronically contacts the memory storage device 124 and then transmits the unique identifier to the memory storage device. In this embodiment the cell phone would also contact the police data base and register the receipt of the first signal into the memory of the police data base. The device memory storage device then transmits the information related to the unique identifier to the cell phone, being the third signal 100, where the information is displayed on the cell phone screen.

In another alternate embodiment the LCD screen may be electronically linked to the receiver 130. The receiver may be in the form of a bracelet 132. The receiver may be in the form of a pocket carried device 134. In this configuration the pocket carried device may have a computer linking member 136 to enable the downloading of the police data base into the pocket carried device.

In another alternate embodiment the cell phone associated with the receiver may transmit, via a fourth signal 140, the information containing the unique identifier to a remote receiving device, such as a home computer 150 having a memory. The information is stored within the memory of the home computer.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A monitored felon warning system comprising, in combination:

a police computer having a felon data base;

a global positioning system, also known as GPS;

a sending subassembly having a circuit, with a transmitter being capable of transmitting a first signal;

a person wearing the sending subassembly, the person being a member of class of persons that includes convicted felons and persons under court order;

a receiving subassembly in the possession of a user comprising a power source and a circuit, the receiver subassembly being configured to produce a second signal responsive to receiving said first signal indicative of unauthorized proximity;

a cell phone in the possession of said user being electronically coupled to the receiving subassembly and to the felon data base, the cell phone receiving the second signal from the receiving subassembly and the cell phone then coupling to the data base and transmitting the contents of the second signal to the data base;

the data base, upon receiving the contents of the second signal, then generating and transmitting a third signal containing the felon's warning information to the cell phone, where the warning information is displayed on an LCD of the cell phone for the user to view.

2. A monitored felon warning system as described in claim 1 with the police computer further comprising a memory and a processor, the computer being coupled to a cellular telephone system, the data base being configured to store information concerning a member of the class of persons that includes convicted felons and persons under court order, with each member of the class of persons identified with a unique identifying code, with the data base also being enabled to transmit warning information concerning convicted felons and persons under court order via the cellular telephone system, the warning information transmitted being a member of the class of information that includes physical description, photograph and warnings.

3. A monitored felon warning system as described in claim 1 wherein the system further comprises:

the sending subassembly circuit comprising a processor and a power source and a transmitter and a global positioning system location identifier; and the first signal containing the unique identifying code and the GPS location of the sending subassembly.

4. A monitored felon warning system as described in claim 1 wherein the receiving subassembly circuit further comprises:

a memory and a processor and a receiver and a transmitter and a global positioning system location identifier and an alarm, with the alarm being a member of the class of alarms that includes audio alarm, tactile alarm and visual alarm; and, the receiver subassembly further being capable of receiving and processing the first signal containing the unique identifying code and the GPS location originating from the sending subassembly.

5. A monitored felon warning system as described in claim 1 wherein the second signal comprises a unique identifier and the receiver subassembly GPS location and the sending subassembly GPS location.

6. A monitored felon warning system as described in claim 1 with the cell phone having an LCD screen and having a circuit and an associated processor and an associated memory.

7. A monitored felon warning system for allowing a user to get information of approaching monitored felons, comprising, in combination:

a police computer having a felon data base, the computer having a memory and a processor, the computer being coupled to a cellular telephone system, the data base configured to store information concerning a member of the class of persons that includes convicted felons and persons under court order, with each member of the class of persons identified with a unique identifying code, with the data base also being enabled to transmit warning information concerning convicted felons and persons under court order via the cellular telephone system, the warning information transmitted being a member of the class of information that includes physical description, photograph and warnings;

a global positioning system, also known as GPS;

a sending subassembly, the sending subassembly having a circuit, the circuit comprising a processor and a power source and a transmitter and a global positioning system location identifier, with the transmitter being capable of transmitting a first signal containing a unique identifying code and the GPS location of the sending subassembly;

a person wearing the sending subassembly, the person being a member of class of persons that includes convicted felons and persons under court order;

a receiving subassembly in the possession of a user comprising a power source and a circuit, the circuit comprising a memory and a processor and a receiver and a transmitter and a global positioning system location identifier and an alarm, with the alarm being a member of the class of alarms that includes audio alarm, tactile alarm and visual alarm, with the receiver subassembly being capable of receiving and processing the first signal containing the unique identifying code and the GPS location originating from the sending subassembly, the receiver subassembly being configured to produce a second signal, the second signal comprising the unique identifier and the receiver subassembly GPS location and the sending subassembly GPS location;

a cell phone in the possession of a user having an LCD screen and having a circuit and an associated processor and an associated memory, with the cell phone being electronically coupled to the receiving subassembly, with the cell phone also being electronically coupled to the felon data base, the cell phone receiving the second signal from the receiving subassembly and the cell phone then coupling to the data base and transmitting the contents of the second signal to the data base;

the data base, upon receiving the contents of the second signal, then generating and transmitting a third signal containing the felon's warning information to the cell phone, where the warning information is displayed on the LCD of the cell phone for the user to view.

* * * * *